US005988132A

United States Patent [19]

Watanabe

[11] Patent Number: 5,988,132

[45] Date of Patent: Nov. 23, 1999

[54] PULL STARTER FOR OUTBOARD MOTOR

[75] Inventor: Kazuhiko Watanabe, Hamamatsu, Japan

[73] Assignee: Sanshin Kogyo Kabushiki Kaisha, Hamamatsu, Japan

[21] Appl. No.: 09/027,609

[22] Filed: Feb. 23, 1998

[30] Foreign Application Priority Data

Feb. 21, 1997 [JP] Japan ..... 9-037612

[51] Int. Cl.[6] ..... F02N 3/02

[52] U.S. Cl. ..... 123/185.2; 440/77; 440/85

[58] Field of Search ..... 123/185.2, 185.3, 123/185.4, 198 E; 440/77, 76, 85, 900

[56] References Cited

U.S. PATENT DOCUMENTS

| | | | |
|---|---|---|---|
| 2,374,685 | 5/1945 | Kissel et al. | 123/185.9 |
| 2,942,599 | 6/1960 | Irgens | 123/185.4 |
| 3,814,073 | 6/1974 | Nakatani | 123/185.2 |
| 4,230,085 | 10/1980 | Baltz | 123/185.2 |
| 4,721,485 | 1/1988 | Suzuki . | |
| 4,909,201 | 3/1990 | Nagashima et al. | 123/185.3 |
| 5,064,393 | 11/1991 | Inoue . | |

FOREIGN PATENT DOCUMENTS

| | | | |
|---|---|---|---|
| 0153971 | 9/1984 | Japan | 123/185.3 |

*Primary Examiner*—Noah P. Kamen
*Assistant Examiner*—Hai Huynh
*Attorney, Agent, or Firm*—Knobbe, Martens, Olson, & Bear LLP

[57] ABSTRACT

A pull starter for an engine powering an outboard motor having a cowling and a water propulsion device is disclosed. The engine is positioned in the cowling and has a generally vertically extending crankshaft. A lower end of the crankshaft is arranged to drive the water propulsion device. The starter includes a drum connected to the crankshaft at a top end of the engine, a starter cord having a first end connected to the drum and a second end connected to a handle, and a cord guide for guiding the cord through the cowling, the cord guide including an arcuate cord-engaging surface. The cord extends through said cowling in a first direction and is then guided by the arcuate surface of the cord guide into a second direction to the drum.

10 Claims, 5 Drawing Sheets

PULL STARTER FOR OUTBOARD MOTOR

FIELD OF THE INVENTION

The present invention relates to a starter for an engine of the type utilized to power an outboard motor. More particularly, the invention is a pull starter arrangement for such a motor.

BACKGROUND OF THE INVENTION

Internal combustion engines are commonly utilized to power the propeller of an outboard motor. In these types of motors, the engine is mounted in an enclosure formed by a cowling. The engine is oriented with its crankshaft vertically extending, with a bottom end of the crankshaft arranged to drive a drive shaft. This drive shaft extends through a lower portion of the motor to a transmission for selectively driving the propeller.

In some instances, the engine is provided with an electric starter for starting the engine. In others, only a manual starter is provided, or a manual starter is provided in addition to the electric starter for those situations where insufficient power is available to power the electric starter.

The manual pull-type starter typically comprises a drum or pulley connected to the crankshaft of the engine. One end of a flexible cord is attached to the pulley. A knob is positioned at the opposite end of the cord. The operator of the motor grips the knob and pulls outwardly on the cord, rotating the pulley and thus rotating the crankshaft, starting the engine.

To provide convenient access to the manual starter, the knob is located exterior to the cowling of the motor. This requires that the starter cord extend through the cowling from the pulley to the knob, such as through a small aperture in the cowling.

Problems arise with this starter arrangement in that when the cord passes through the cowling at a location or in a direction which is offset from a tangent line extending from the pulley at the point where the cord engages the pulley, the cord rubs on the cowling (i.e. the cord does not pass in a straight line through the opening in the cowling, but engages one side of the opening). When the cord is pulled out to start the engine, and then when retracted automatically by the manual starter, friction between the cord and cowling wears the cord. Eventually, this wearing effect may cause the cord to completely break. Where the engine is provided with only a manual starter, this will result in the operator being unable to start the engine. In addition, the frictional force on the cord increases the pulling force which the user must apply to start the engine.

There is desired an improved pull-type starter for an engine powering an outboard motor in which cord friction is reduced.

SUMMARY OF THE INVENTION

In accordance with the present invention there is provided a pull starter for an engine powering an outboard motor.

The motor is preferably of the type having a cowling and a water propulsion device. The engine is of the internal combustion type and positioned in the cowling. The engine has a generally vertically extending crankshaft. A lower end of the crankshaft is arranged to drive the water propulsion device.

The starter includes a drum connected to the crankshaft at a top end of the engine, a starter cord having a first end connected to the drum and a second end connected to a handle, and a cord guide for guiding the cord through the cowling, the cord guide including an arcuate cord-engaging surface. The cord extends through said cowling in a first direction and is then guided by the arcuate surface of the cord guide into a second direction to the drum.

In one embodiment the cord guide is mounted to the cowling and has a first end for engaging the handle connected to the cord and an opposite end having a face defining the arcuate cord-engaging surface.

In another embodiment, the cord guide includes a first member for engaging the handle connected to the cord and a roller having an outer arcuate surface. The roller is positioned near the first member of the guide and is rotatably connected to the motor.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

In accordance with the present invention, there is provided an outboard motor powered by an engine having a pull starter in accordance with the present invention. The pull starter of the present invention is described for use with an engine powering an outboard motor since this particular application is one for which the pull starter has particular applicability. It should be understood, however, that the pull starter may be used in a variety of other applications.

Figure 1:
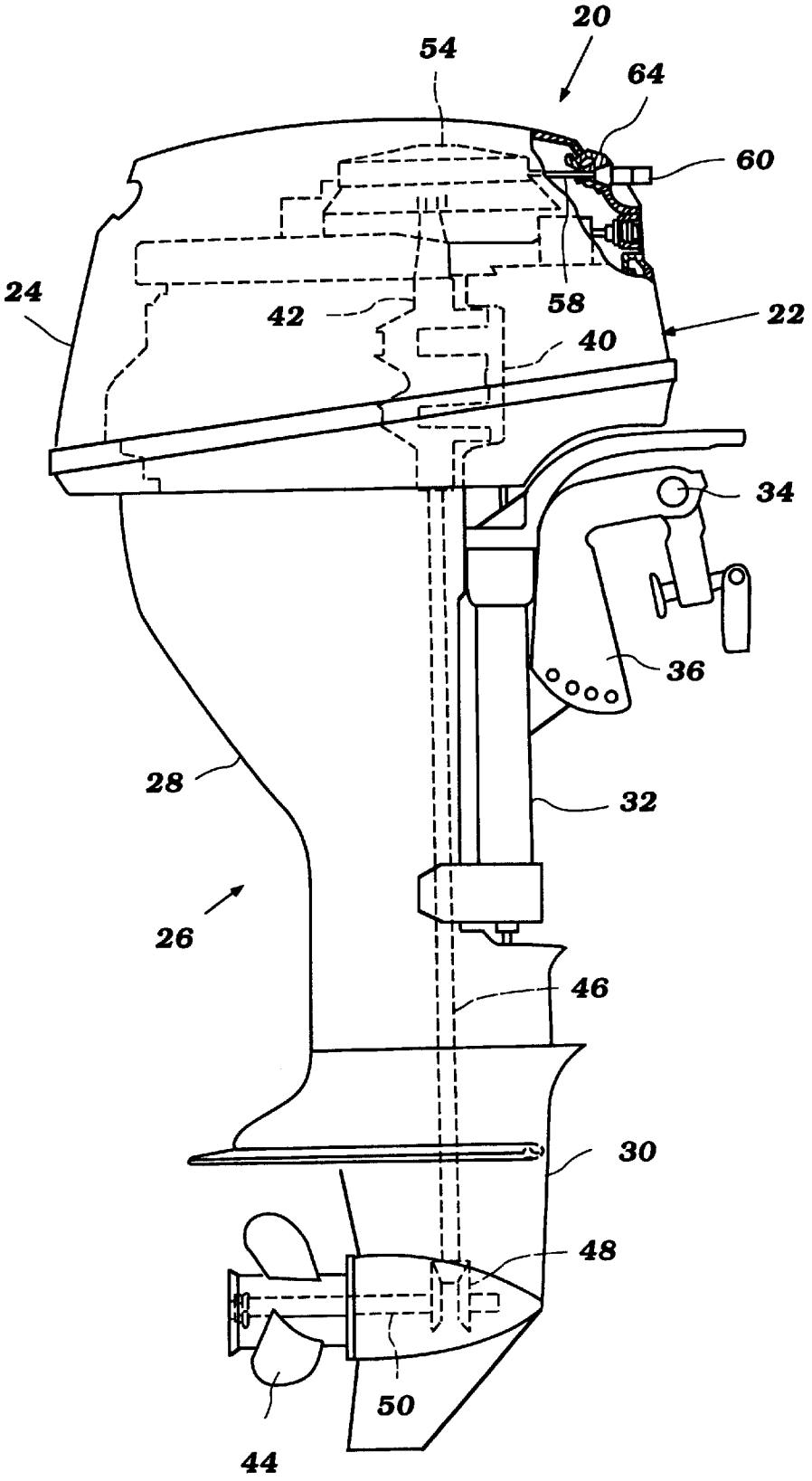
FIG. 1 is a side elevational view of an outboard motor powered by an engine having a pull starter in accordance with a first embodiment of the present invention.

As illustrated in FIG. 1, the outboard motor 20 is of the type generally utilized to propel a watercraft (not shown). The outboard motor 20 has a powerhead area 22 generally defined by a main cowling 24. The motor 20 includes a lower unit 26 extending downwardly from the powerhead 22. The lower unit 26 comprises an upper or "drive shaft housing" section 28 and a lower section 30.

The motor 20 is connected to a steering shaft (not shown). The steering shaft is supported for steering movement about a vertically extending axis within a swivel or steering bracket 32, permitting movement of the motor 20 to the left and right for steering the watercraft to which it is attached.

The swivel bracket 32 is connected by means of a pivot pin 34 to a clamping bracket 36 which may be attached to a transom portion of a hull of the watercraft. The pivot pin 34 permits the outboard motor 20 to be trimmed and tilted up about the horizontally disposed axis formed by the pivot pin 34.

Still referring to FIG. 1, the power head 26 of the outboard motor 20 houses an internal combustion engine 40 which is positioned within the main cowling 24. The engine 40 may operate on a two or four-cycle principle and have as few as one combustion chamber or cylinder. The engine 40 may also be of the rotary type.

One or more members moving as a result of the combustion of air and fuel in the combustion chamber(s) of the engine 40 are arranged to drive a vertically extending crankshaft 42. A lower end of the crankshaft 42 (i.e. that end corresponding to a bottom end of the engine 40) is arranged to drive a water propulsion device associated with the motor 20. Preferably, this water propulsion device comprises a propeller 44.

Preferably, the crankshaft 42 drives a drive shaft 46 which extends downwardly through the lower unit 26, where it drives a bevel gear and a conventional forward-neutral-reverse transmission 48. A control (not shown) is preferably provided for allowing an operator to remotely control the transmission 48, such as from the watercraft. The drive shaft 46 drives a propeller shaft 50 through the transmission 48, the propeller shaft journalled with respect to the lower section 30 of the lower unit 26 in a known manner. A hub of the propeller 44 is coupled to the propeller shaft for providing a propulsive force to the watercraft in a manner well known in this art.

Many of the details of the engine 40 and motor 20 are not illustrated, nor described herein in detail as they form no part of the present invention and are well known to those of skill in the art. For example, though not illustrated, the engine 40 includes an intake system for delivering air to each combustion chamber, a fuel system for delivering fuel, and an ignition system for initiating ignition the air/fuel mixture. An exhaust system routes the products of combustion from the engine, preferably to a point exterior to the motor 20.

In accordance with the present invention, the motor 20 is provided with a means for starting the engine 40. As is well known, when starting an internal combustion engine it is necessary to effectuate movement of the moving members connected to the crankshaft 42 (such as pistons).

The motor 20 may include an electric starter (not shown). In that case, the motor 20 includes a starter button 52 for activating the electric starter (see FIG. 3).

Figure 2:
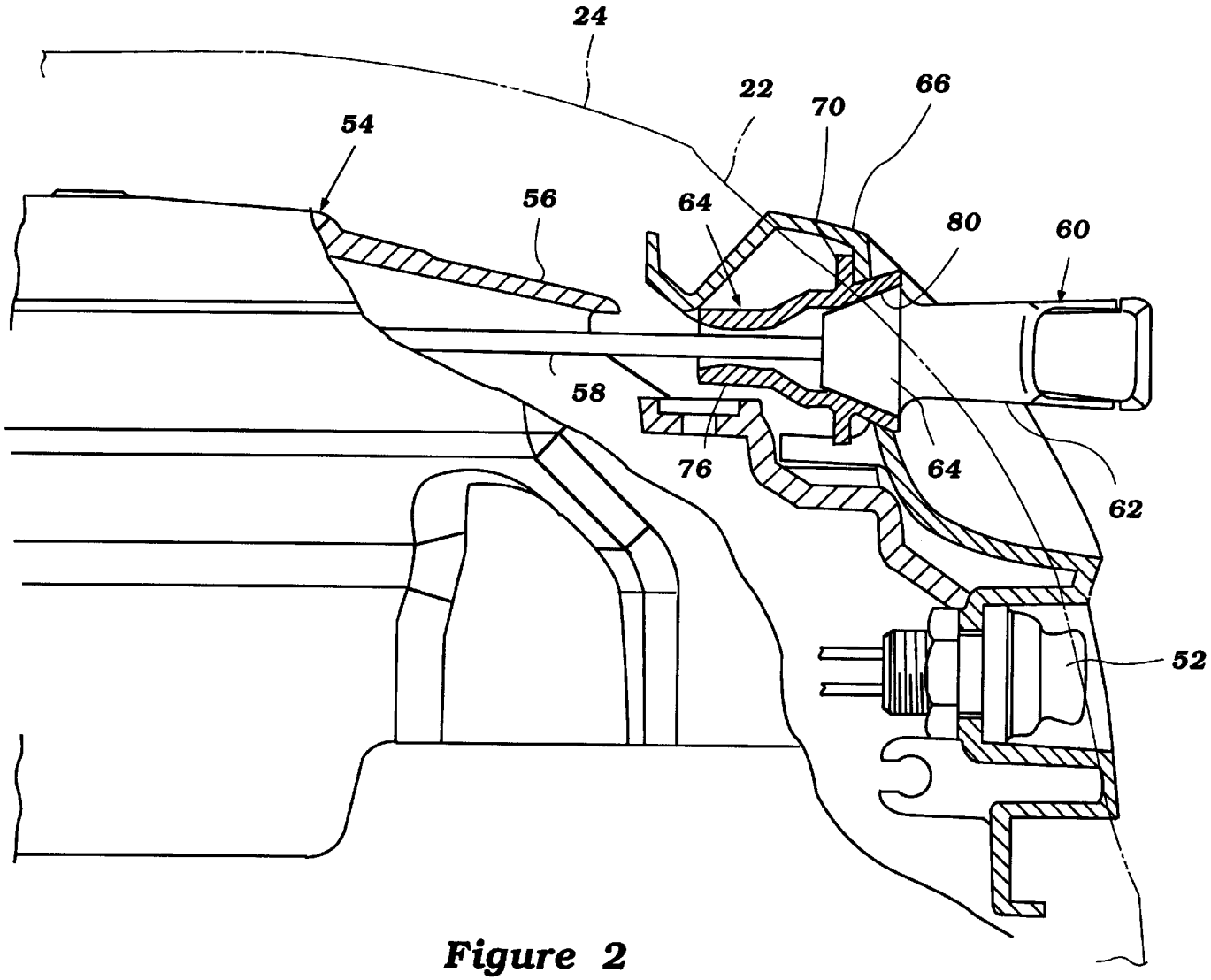
FIG. 2 is a partial cross-sectional side view of the motor illustrated in FIG. 1 illustrating a cord guide and guide mount of the first embodiment pull starter.
Figure 3:
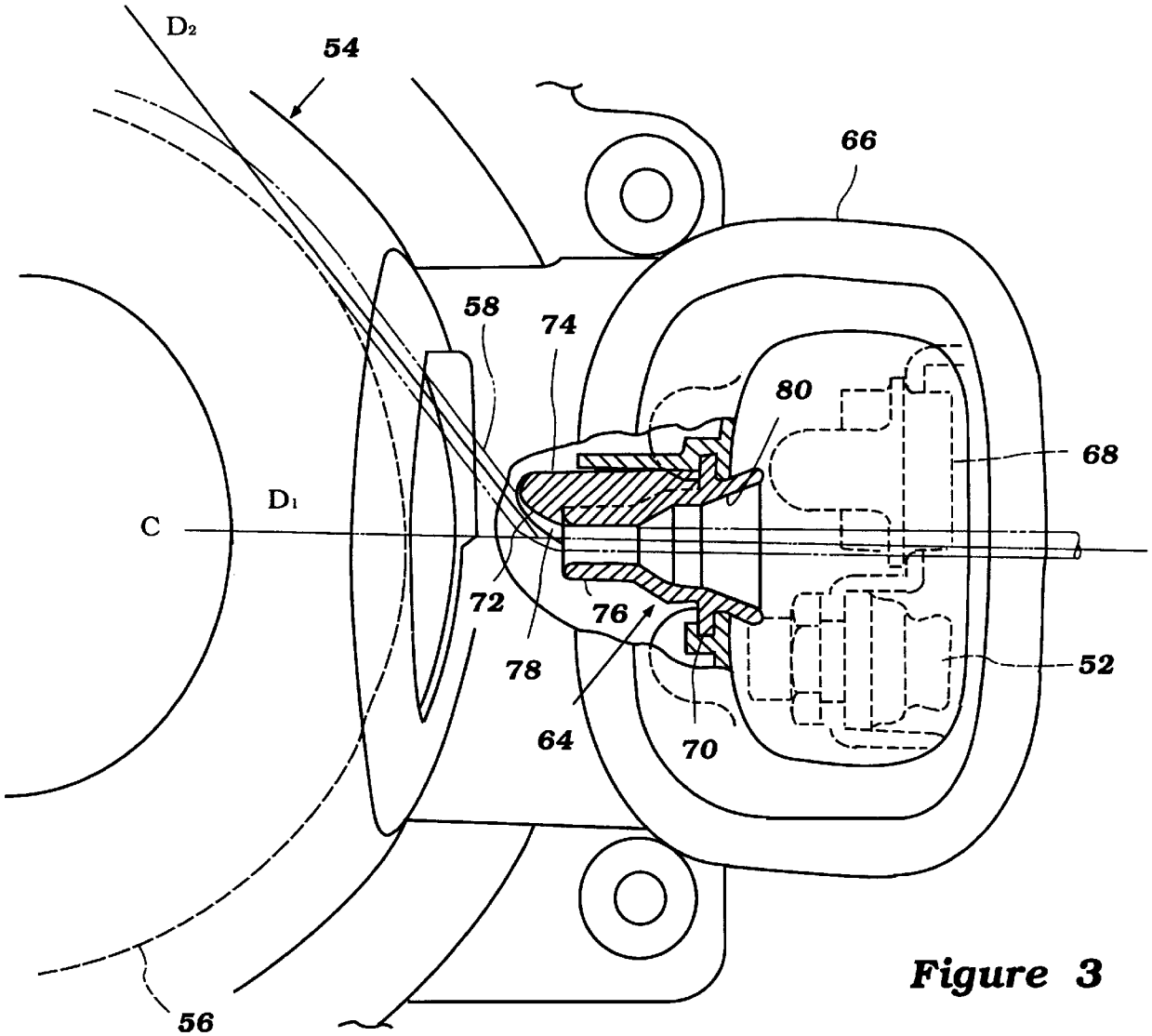
FIG. 3 is a partial cross-sectional top view of the motor illustrated in FIG. 1.

Referring to FIGS. 2 and 3, the motor 20 includes a manual or pull starter 54. The manual starter 54 includes a drum or rotor 56 which is mounted to the crankshaft 42 at the top end of the engine 40. The drum 56 includes a re-coil mechanism (not shown) of a type known to those of skill in the art.

Means are provided for rotating the drum 56 (in a direction opposite the re-coil mechanism) for starting the engine. Preferably, this means comprises a rope or cord 58.

A handle 60 is connected to one end of the starter cord 58, while the opposite end is connected to the drum 56. The handle 60 has a grip portion 62 and an attachment portion 64.

The starter 54 includes a cord guide 64 and a guide mount 66. As illustrated, the guide mount 66 is connected to the main cowling 24 of the motor 20. The electric starter switch or button 52 and one or more other features, such as a lamp 68 indicating the condition of the electric starting system, are connected to the guide mount 66.

The cord guide 64 is connected to the guide mount 66 by a mounting flange 70 on the guide 64 which engages a slot in the guide mount 66. Of course, the cord guide 64 may be formed integrally with the guide mount 66 instead of comprising a separate element.

Figure 4:
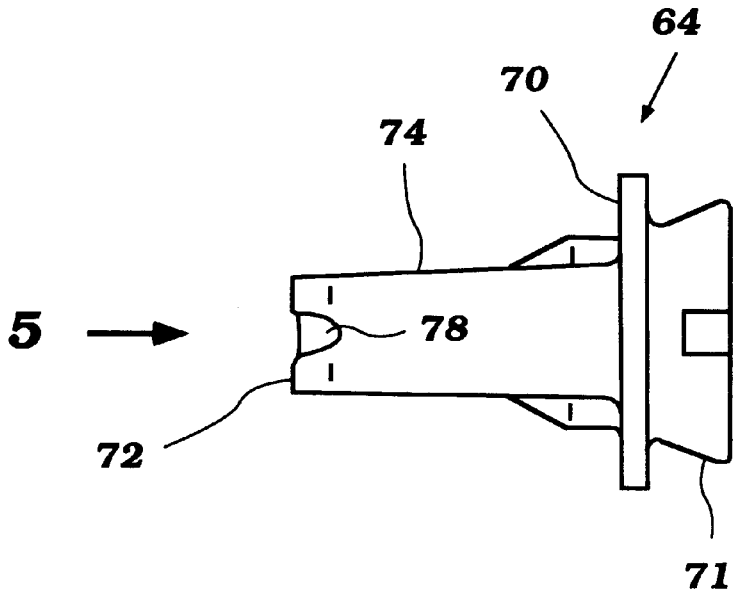
FIG. 4 is a side elevational view of the cord guide of the first embodiment pull starter.
Figure 5:
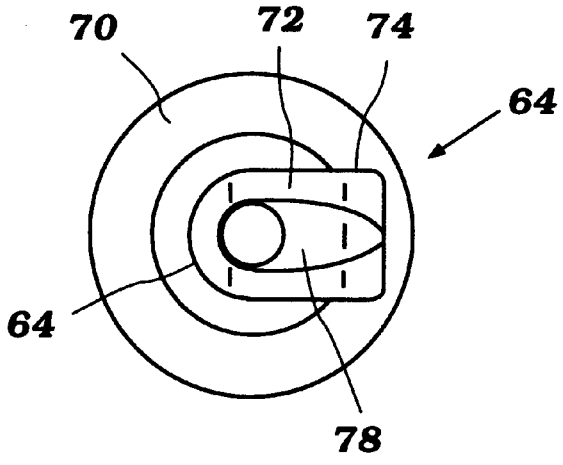
FIG. 5 is an end view of the cord guide illustrated in FIG. 4 taken in the direction of arrow 5 therein.

The cord guide 64 is illustrated in more detail in FIGS. 4 and 5. On one side of the flange 70 is defined a handle mount section 71. On the opposite side of the flange 70 the guide 64 comprises a generally cylindrical body 76. A guide flange 74 extends outwardly from the body 76. The guide flange 74 has an arcuate face 72 with a cord slot 78 defined therein. The slot 78 is a recessed area of the face 72 which serves to guide the cord 58.

As illustrated in FIG. 2, the cord guide 64 is hollow, defining a passage through which the cord 58 extends (this passage comprising the passage through the cowling 24 for the cord 58). Preferably, the passage through the handle mount section 71 of the cord guide 64 is defined by a tapered wall 80 for engaging a mating surface of the handle 60. In particular, the pull starter 54 is preferably of the recoil type in which the drum 56 is biased to rotate and draw the starter cord 58 about the drum 56. The engagement of the handle 60 with the tapered wall 80 of the guide 64 prevents the drum 56 from rotating to an extent that the cord 58 is entirely wrapped thereabout (by the re-coil mechanism) and inaccessible from the outside of the cowling.

Referring to FIG. 3, the guide mount 66 is positioned generally centrally at an end of the cowling 24. The guide 64 as connected to the mount 66 is arranged so that the handle mount section 71 is exterior to the cowling 24, while the guide flange 74 including arcuate face 72 is positioned inside the cowling. So positioned, the cord 58 extends through the cord guide 64 along a line which is generally the same as a centerline C through the powerhead 22 of the motor 20 from end to end (and through the crankshaft 42).

On the other hand, the drum 56 extends radially outward from the crankshaft 42. One point along the periphery of the drum 56 is positioned a maximum distance from the centerline (the distance equaling the radius of the drum). This point is positioned along a line extending perpendicular to the above-referenced centerline.

Since the cord 58 is wrapped around the drum 56, including the point on the drum which is a maximum distance from the centerline, the cord 58 first extends in a first direction D1 along the centerline C, and then in a second direction D2 to the drum 56 before engaging the periphery of the drum 56.

The cord guide 64 is used to transition or guide the cord 58 from the first direction D1 to the second direction D2. Preferably, this change in direction of the cord 58 is accomplished in a manner which reduces the friction on the cord. This reduces cord wear and lessens the force necessary to pull the cord manually to start the engine 40.

The cord 58 first extends in the first direction D1 along the centerline C through the passage in the cord guide 58. The cord 58 then extends along the arcuate or curved face 72 (which curves or bends in the direction D1 to D2) of the guide flange 74. As illustrated in FIG. 3, the cord 58 preferably extends within the slot 78 in the face 72, following the same radius of curvature of the face 72. As the cord 58 extends along this face 72, it is redirected from direction D1 to direction D2, thereafter extending in tangential fashion to the periphery of the drum 56.

Figure 6:
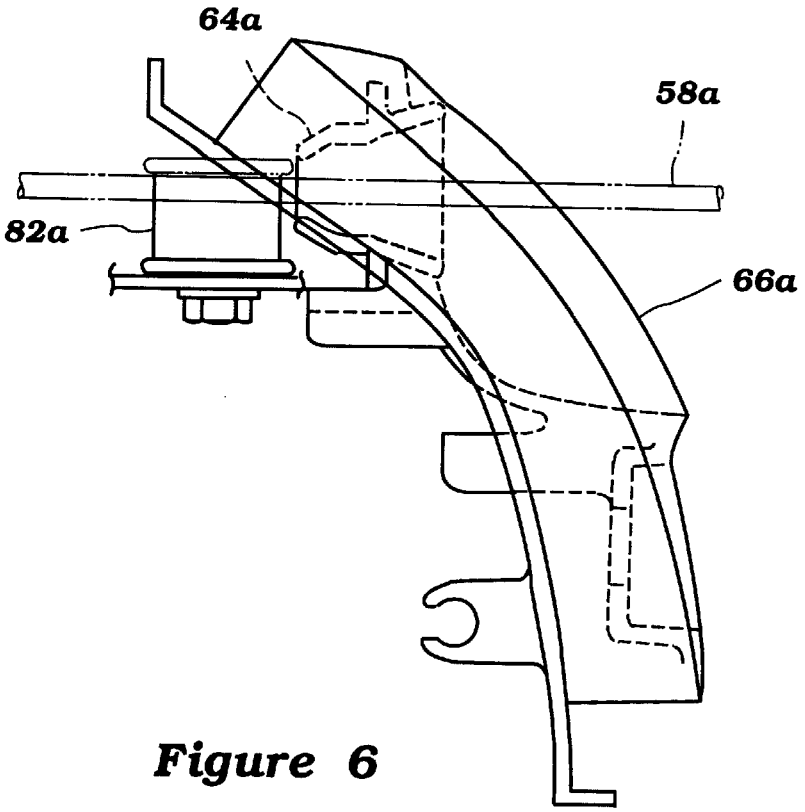
FIG. 6 illustrates in side view a portion of a motor having a pull starter in accordance with a second embodiment of the present invention.
Figure 7:
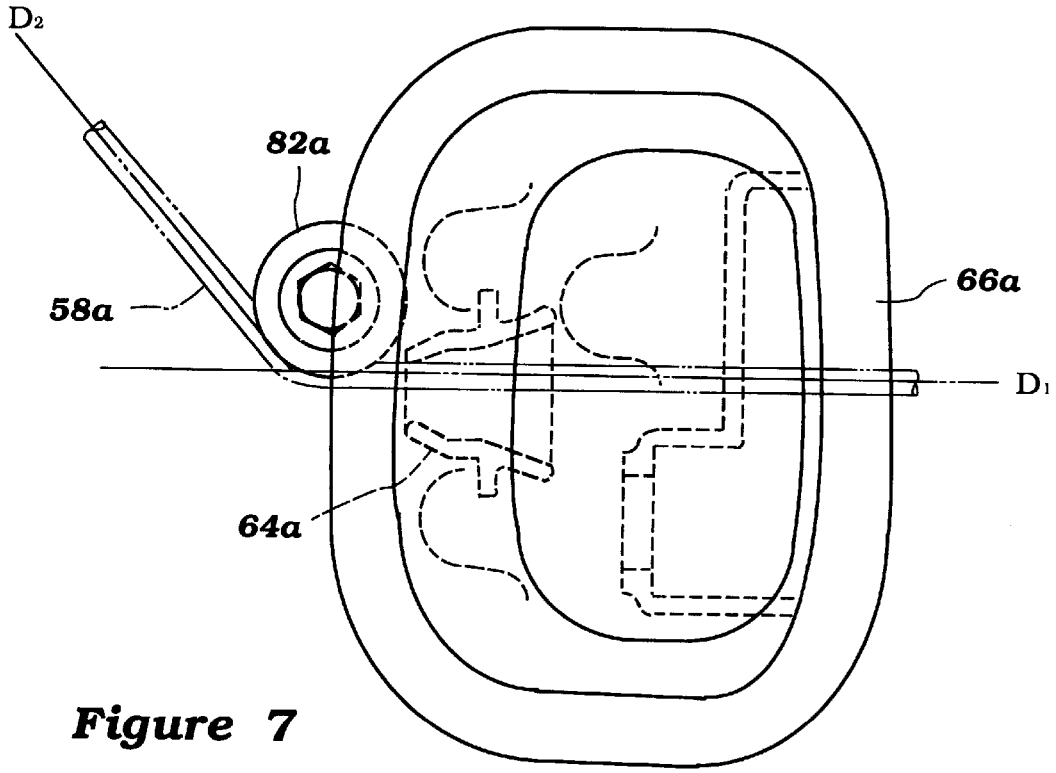
FIG. 7 is a top view of the pull starter illustrated in FIG. 6.

A second embodiment pull starter arrangement is illustrated in FIGS. 6 and 7. In the description and figures of this embodiment, like parts have been given like reference numerals to those of the first embodiment, except that an "a", designator has been added to all of the reference numerals of this embodiment.

In this embodiment, the cord guide 64*a* includes a guide-body as described above, but does not include the mounting flange 72*a* connected thereto. Instead, the cord guide 64*a* includes a pulley or roller 82*a*. This roller 82*a* is rotatably mounted (separately from the first section or body of the guide which defines the passage through the cowling) with an axis thereof extending generally parallel to the axis along which the crankshaft extends. The roller 82*a*, which is generally cylindrical in shape, has an outside surface which is arcuate.

The roller 82*a* is mounted near the end of the cylindrical section of the cord guide 64*a* with the outer surface tangent to the line through the cylindrical part of the guide 64*a* along which the cord 58*a* extends.

In this embodiment, the roller 82*a* redirects the cord 58*a* along its path from first direction D1 to the second direction D2. While the arcuate surface of the roller 82*a* would be solely sufficient for this purpose, the guide of this embodiment has the further advantage that the roller 82*a* rotates. The roller 82*a* is rotatably mounted, so as the cord 58*a* moves, the roller 82*a* moves, thereby further reducing the friction between the guide and cord, since there is little relative movement between the roller and cord.

Of course, the foregoing description is that of preferred embodiments of the invention, and various changes and modifications may be made without departing from the spirit and scope of the invention, as defined by the appended claims.

What is claimed is:

1. A pull starter for an engine powering an outboard motor, the motor having a cowling defining an opening in an upper, forwardly facing, central surface thereof and a water propulsion device, said engine positioned within said cowling and having a generally vertically extending crankshaft, said crankshaft arranged to drive said water propulsion device, said starter including a drum connected to said crankshaft at a top end of said engine, a starter cord having a first end connected to said drum and a second end adapted to extend through said cowling opening and connected to a handle, and a cord guide affixed within said opening for guiding said cord through said cowling, said cord guide defining a passage through which said cord extends and having an arcuate surface spaced inwardly from said passage toward said drum, said cord extending through said cowling opening and through said cord guide passage in a first direction and then guided by said arcuate surface of said cord guide into a second direction to said drum.

2. The pull starter in accordance with claim 1, wherein said arcuate surface comprises the exterior of a roller.

3. The pull starter in accordance with claim 2, wherein said roller is rotatably mounted to said cord guide.

4. The pull starter in accordance with claim 1, wherein said cord guide has a body with a first end and a second end, said first end defining the passage and adapted to receive a portion of said handle and said second end having a face defining said arcuate surface.

5. The pull starter in accordance with claim 4, wherein said motor has a centerline passing through said crankshaft, and said first direction is along said centerline.

6. The pull starter in accordance with claim 5, wherein said second direction is a line intersecting said centerline at an angle and extending tangential to an outer surface of said drum.

7. The pull starter in accordance with claim 1, wherein said cord guide includes a mounting flange surrounding the passage and affixed to and engaging said cowling around said cowling opening.

8. The pull starter in accordance with claim 1, wherein said cord guide has a body with a passage through which said cord extends.

9. The pull starter in accordance with claim 1, wherein the cord guide further mounts a control for the engine.

10. The pull starter in accordance with claim 9, wherein the control for the engine mounted by the cord drive comprises a starter switch.

* * * * *